US011400736B2

(12) United States Patent
Yamane et al.

(10) Patent No.: US 11,400,736 B2
(45) Date of Patent: Aug. 2, 2022

(54) IMAGE FORMING APPARATUS

(71) Applicant: KYOCERA Document Solutions Inc., Osaka (JP)

(72) Inventors: Naoki Yamane, Osaka (JP); Toshinori Muraoka, Osaka (JP); Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 706 days.

(21) Appl. No.: 16/416,305

(22) Filed: May 20, 2019

(65) Prior Publication Data

US 2019/0367303 A1 Dec. 5, 2019

(30) Foreign Application Priority Data

Jun. 4, 2018 (JP) ..... JP2018-106777

(51) Int. Cl.

| | |
|---|---|
| ***B41J 11/20*** | (2006.01) |
| ***B41J 11/00*** | (2006.01) |
| ***B41J 2/165*** | (2006.01) |
| *B41J 29/02* | (2006.01) |

(52) U.S. Cl.

CPC ..... *B41J 11/20* (2013.01); *B41J 2/16511* (2013.01); *B41J 11/0045* (2013.01); *B41J 29/02* (2013.01)

(58) Field of Classification Search

CPC ..... B41J 11/20

See application file for complete search history.

(56) References Cited

FOREIGN PATENT DOCUMENTS

| | | | |
|---|---|---|---|
| JP | 3882715 B2 | * | 2/2007 |
| JP | 4164785 B2 | * | 10/2008 |
| JP | 2012-192524 A | | 10/2012 |

* cited by examiner

*Primary Examiner* — Sharon Polk

(74) *Attorney, Agent, or Firm* — Studebaker & Brackett PC

(57) ABSTRACT

The image forming apparatus includes a moving unit, a movable connector, a fixed connector, a wire, a fixed wire guide and a movable wire guide. The moving unit is supported by a casing in an upwardly and downwardly moving manner. The movable connector is provided in the moving unit. The fixed connector is provided in the casing. Both ends of the wire are connected to the movable connector and the fixed connector. The wire has a length longer than a distance between the movable connector and the fixed connector at lifting of the moving unit. The fixed wire guide is supported on the bottom plate of the moving unit. The movable wire guide is supported on the bottom plate of the casing. At least one of the movable wire guide and the fixed wire guide is supported rotatably.

6 Claims, 6 Drawing Sheets

IMAGE FORMING APPARATUS

INCORPORATION BY REFERENCE

This application is based on and claims the benefit of priority from Japanese Patent application No. 2018-106777, filed on Jun. 4, 2018, which is incorporated by reference in its entirety.

BACKGROUND

The present disclosure relates to an inkjet type image forming apparatus.

An inkjet type image forming apparatus is provided with a head unit and a moving unit. The head unit includes an inkjet head having a discharge opening facing downward. The moving unit is supported by a casing in an upwardly and downwardly movable manner in directions close to or apart from the head unit from the lower side.

The moving unit is provided with a relay board which is electrically connected to a motor for driving a conveyance belt and a sensor for detecting a conveyance speed of the conveyance belt to supply electric power and to transmit a signal. On the other hand, the casing is provided with a casing side connector electrically connected to a power source and a controller. The relay board and the casing side connector are electrically connected via a wire bundle.

As described above, when the moving unit is lifted and lowered with respect to the casing, a distance between the casing side connector and the relay board is varied to vary a posture of the wire bundle. That is, when the moving unit is lifted with respect to the casing, the wire bundle takes almost a straight posture along the upper-and-lower direction. On the other hand, when the moving unit is lowered with respect to the casing, the distance between the casing side connector and the relay board becomes shorter than a length of the wire bundle, and the posture of the wire bundle is varied into a bent posture. Then, the wire bundle is locally applied with load, and a contact failure and a trouble on the lifting and lowering of the moving unit may occur.

SUMMARY

In accordance with an aspect of the present disclosure, an image forming apparatus includes a moving unit, a movable connector, a fixed connector, a wire, a movable wire guide and a fixed wire guide. The moving unit is supported by a casing in an upwardly and downwardly moving manner. The movable connector is provided in the moving unit. The fixed connector is provided in the casing. The wire both ends of which are connected to the movable connector and the fixed connector. The wire has a length longer than a distance between the movable connector and the fixed connector at lifting of the moving unit. The wire is disposed in a moving space between a bottom plate of the moving unit and a bottom plate of the casing. The movable wire guide is supported on the bottom plate of the moving unit and configured to store and guide one end portion of the wire. The fixed wire guide is supported on the bottom plate of the casing and configured to store and guide the other end portion of the wire. At least one of the movable wire guide and the fixed wire guide is supported rotatably on a horizontal plane, and a slack of the wire at lowering of the moving unit is guided so as to be dragged along the horizontal plane in the moving space.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
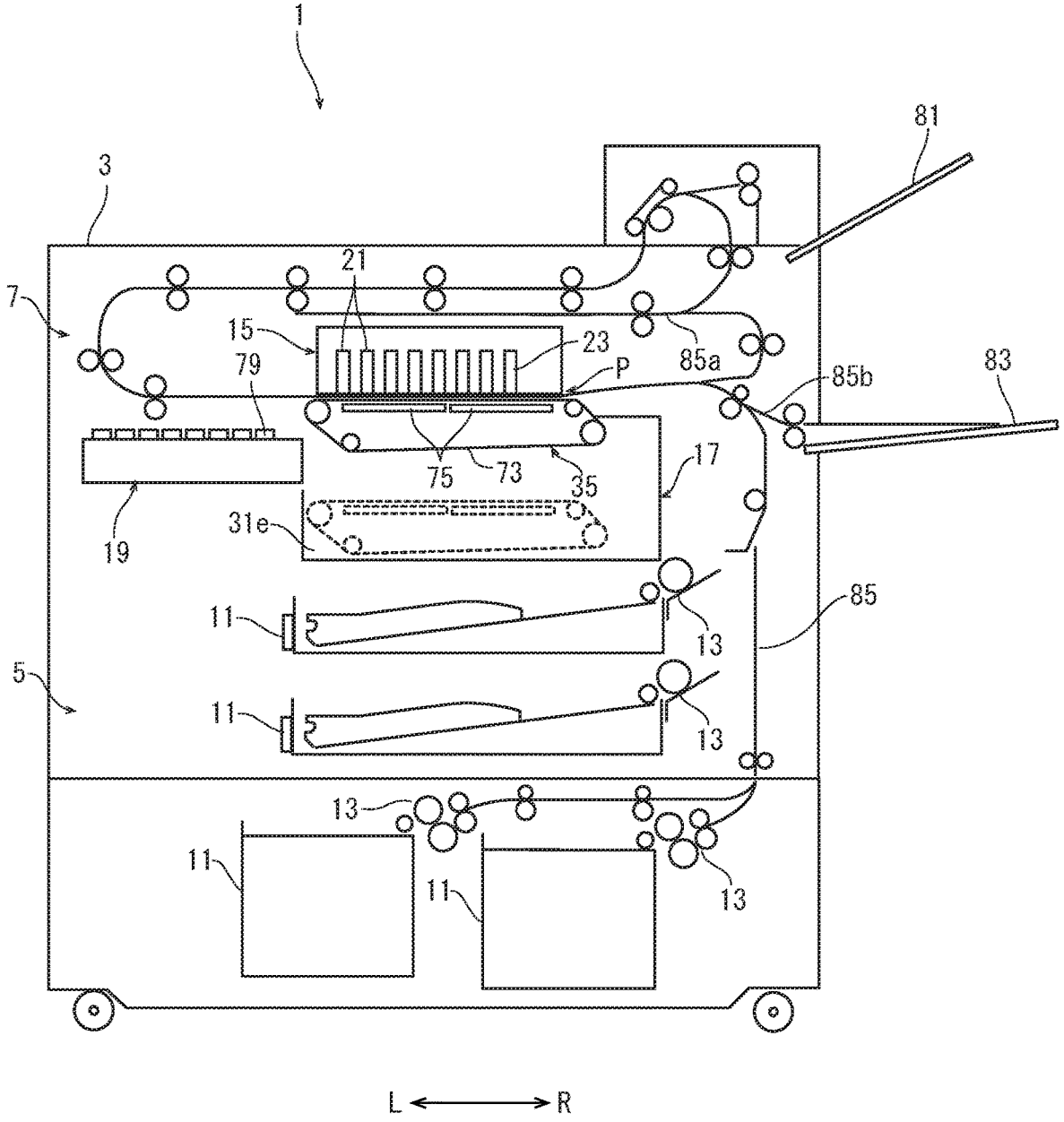
FIG. 1 is a front view schematically showing an inner structure of an image forming apparatus (at an image forming operation) according to an embodiment of the present disclosure.

With reference to FIG. 1, the image forming apparatus 1 will be described. FIG. 1 is a front view schematically showing an inner structure of the image forming apparatus (at an image forming operation). In the following description, a near side of a paper surface of FIG. 1 is defined to be a front side of the image forming apparatus 1. "Fr", "Rr", "U", "L" and "R" in each figure respectively indicate "a front side", "a rear side", "a left side" and "a right side" of the image forming apparatus.

An apparatus main body 3 of the image forming apparatus 1 is provided with a sheet feeding part 5 and an inkjet type image forming part 7. The sheet feeding part 5 is disposed in a lower portion in the apparatus main body 3, and includes a plurality of sheet feeding cassettes 11 storing sheets S and sheet feeding devices 13 feeding the sheet S from the respective sheet feeding cassettes 11. The image forming part 7 is disposed in an upper portion in the apparatus main body 3, and includes a head unit 15, a conveyance unit assembly 17 and a treatment unit 19.

The head unit 15 includes four line heads 21 corresponding to inks of four colors (yellow, magenta, cyan and black). The four line heads 21 are disposed side by side in the left-and-right direction. Each of the line heads 21 includes three inkjet heads 23. The three inkjet heads 23 are aligned in zigzag in the front-and-rear direction, and connected to ink tanks storing the corresponding inks. The inkjet head 23 has a plurality of nozzles each having a discharge opening, and piezoelectric elements provided in the respective nozzles. The nozzles are supported with the discharge openings facing downward. When applied with voltage, the piezoelectric element is deformed to push out the ink in the nozzle and to discharge it through the discharge opening.

Figure 2:
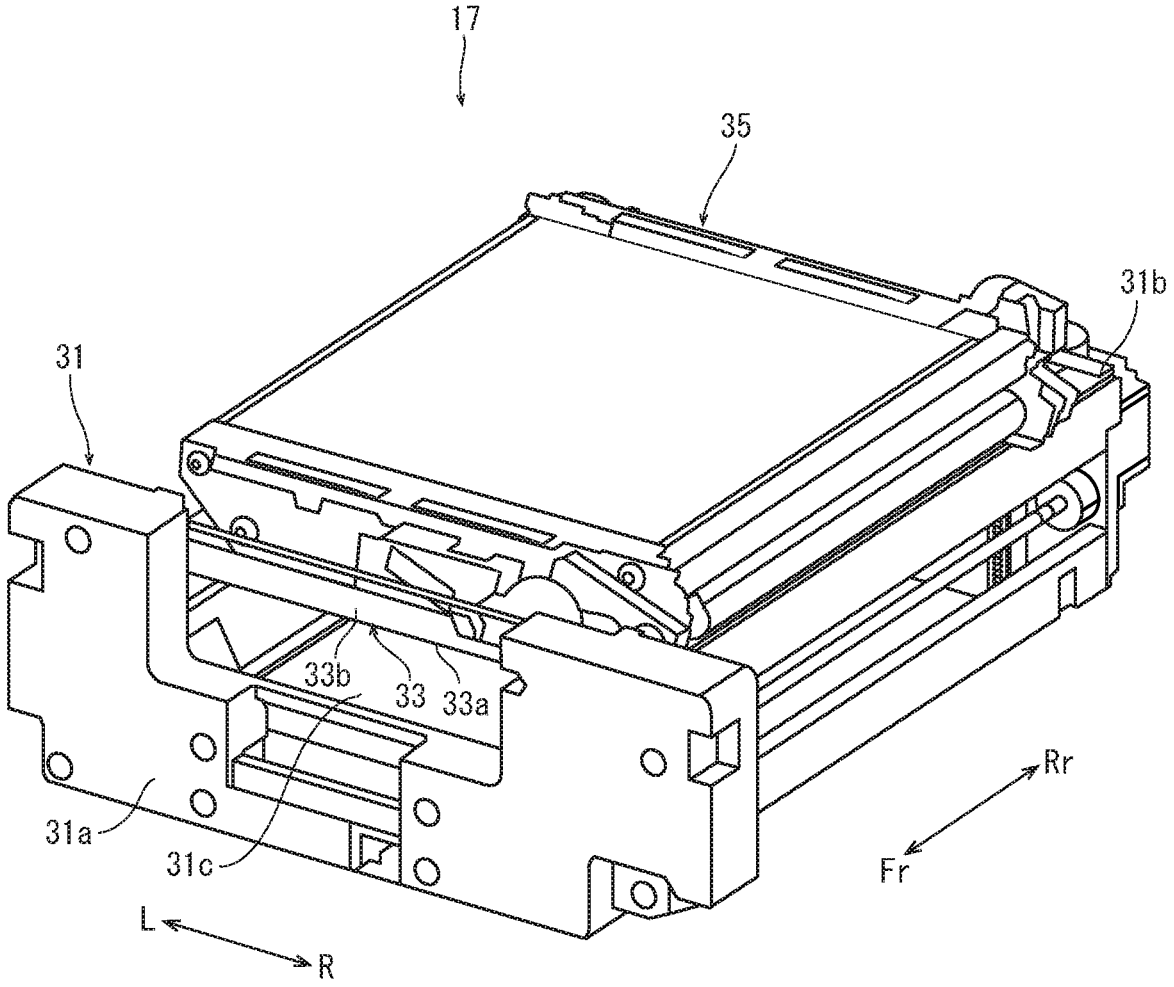
FIG. 2 is a perspective view showing a conveyance unit assembly in the image forming apparatus according to the embodiment of the present disclosure.
Figure 4:
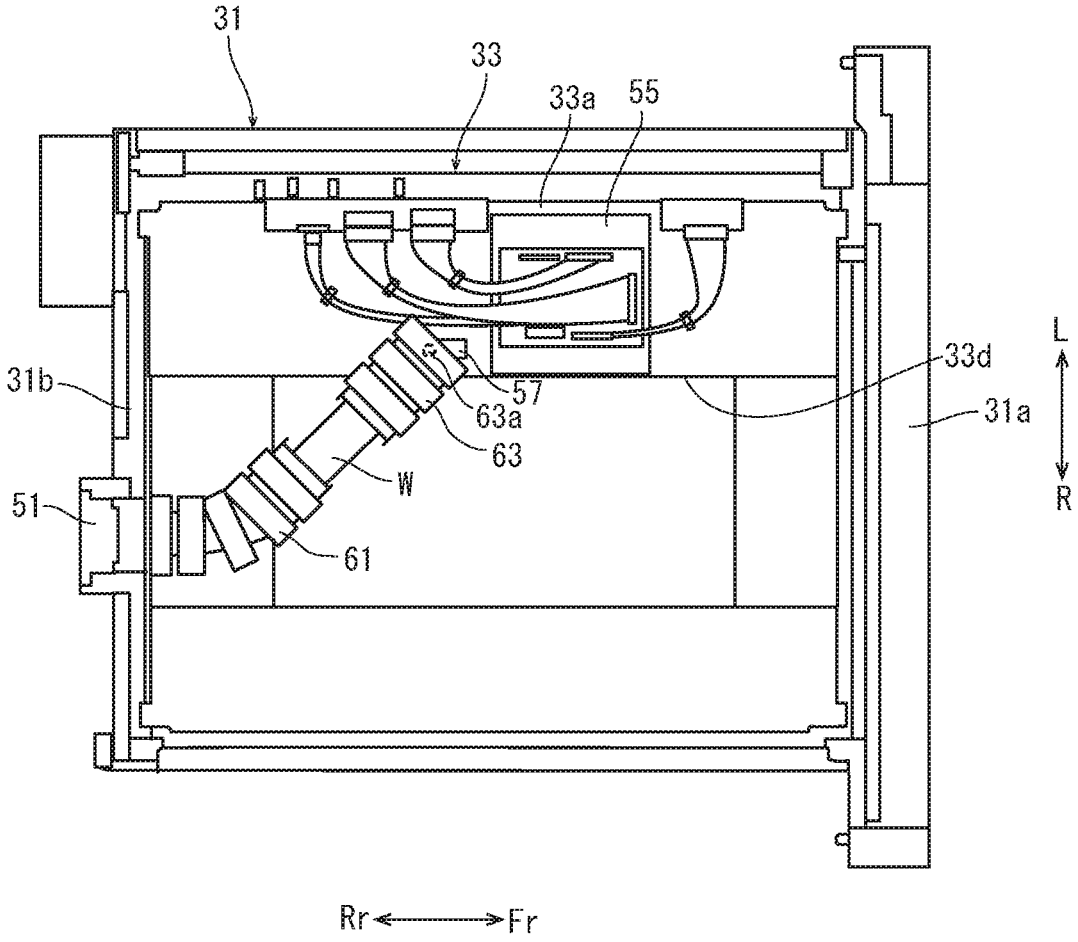
FIG. 4 is a bottom view showing the conveyance unit assembly (when the moving unit is lifted) in the image forming apparatus according to the embodiment of the present disclosure.
Figure 5:
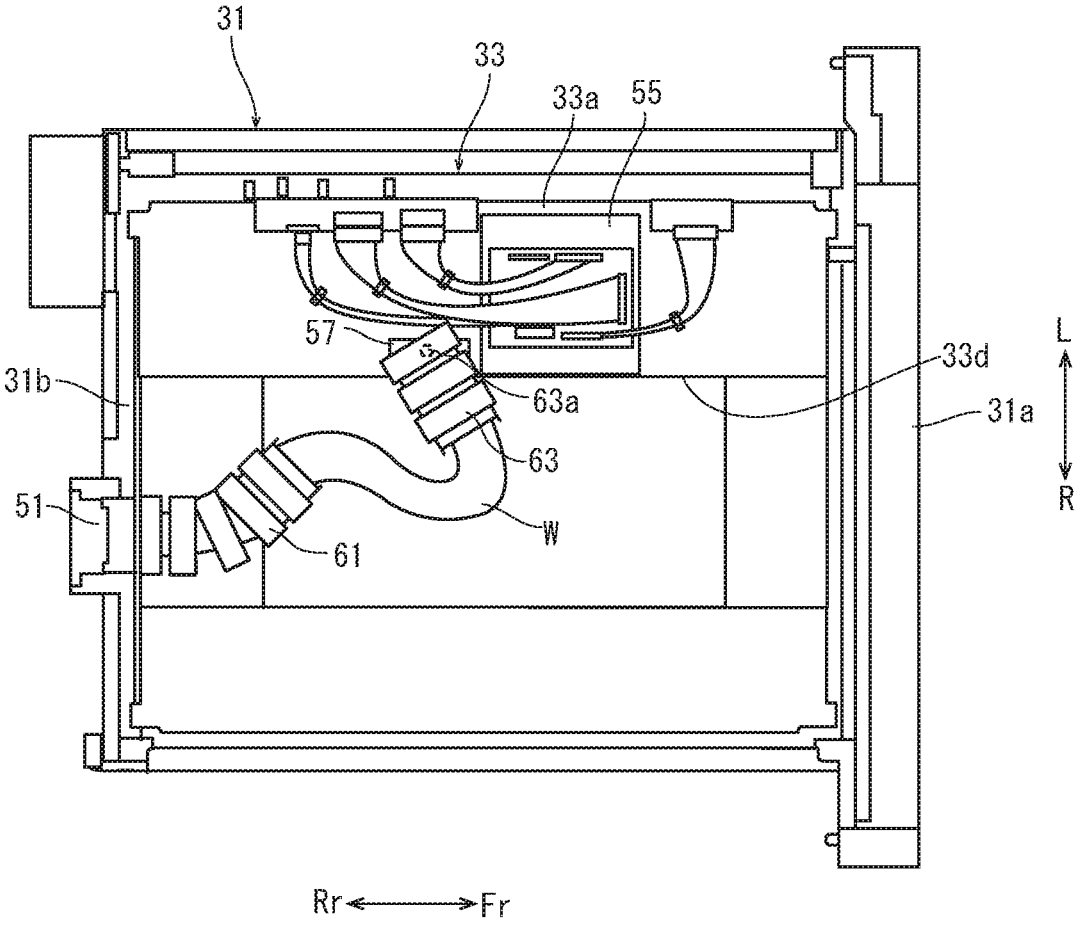
FIG. 5 is a bottom view showing the conveyance unit assembly (when the moving unit is lowered) in the image forming apparatus according to the embodiment of the present disclosure.

Next, the conveyance unit assembly 17 will be described with reference to FIG. 1 to FIG. 5. FIG. 2 is a perspective view showing the conveyance unit assembly, FIG. is a front view schematically showing a positional relationship of each factor of a lifting and lowering mechanism, FIG. 4 and FIG. 5 are bottom views showing the conveyance unit assembly. FIG. 4 and FIG. 5 do not show a bottom plate of the casing.

As showing in FIG. 2, the conveyance unit assembly 17 includes a casing 31, a moving unit 33 supported by the casing 31 in an upwardly and downwardly moving manner, a conveyance unit 35 placed on the moving unit 33 and a lifting and lowering mechanism 37 (refer to FIG. 3) configured to lift and lower the moving unit 33 on which the conveyance unit 35 is placed. As shown in FIG. 1, the conveyance unit assembly 17 is supported by the apparatus main body 3 in an attachable and detachable manner along the front-and-rear direction below the head unit 15.

First, the casing 31 will be described with reference to FIG. 2 and FIG. 3. As shown in FIG. 2, the casing 31 is formed by laterally long front and rear side plates 31*a* and 31*b* facing each other in the front-and-rear direction, left and right side plates facing each other in the left-and-right direction and a bottom plate 31*c*, and has a storage part having a predetermined depth.

Figure 3:
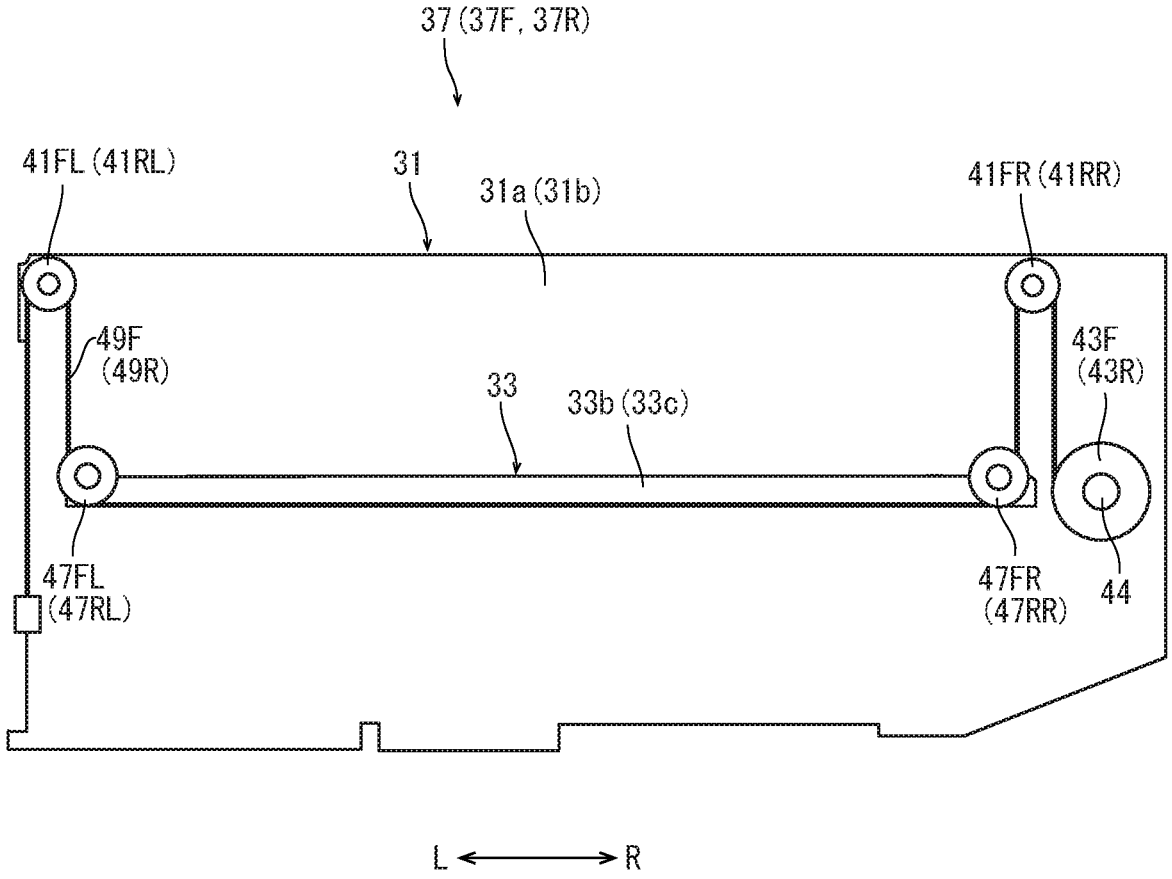
FIG. 3 is a front view schematically showing a positional relationship of each factor of a lifting and lowering mechanism of the conveyance unit assembly, in the image forming apparatus according to the embodiment of the present disclosure.

As shown in FIG. 3, on a rear face of the front side plate 31*a*, left and right front side fixed pulleys 41FL and 41FR are supported in a rotatable manner at the left upper corner portion and at the upper portion of the right end portion. On a front face of the rear side plate 31*b*, left and right rear side fixed pulleys 41RL and 41RR are supported in a rotatable manner at the left upper corner portion and at the upper portion of the right end portion.

On the rear face of the front side plate 31*a*, a front side winding pulley 43F is supported in a rotatable manner at the center portion in the upper-and-lower direction of the right end portion. On the front face of the rear side plate 31*b*, a rear side winding pulley 43R is supported in a rotatable manner at the center portion in the upper-and-lower direction of the right end portion. The front side winding pulley 43F and the rear side winding pulley 43R are respectively positioned outside (the right side) the right front side fixed pulley 41FR and the right rear side fixed pulley 41RR. The front and rear side winding pulleys 43F and 43R are fixed to a winding shaft 44. The winding shaft 44 is supported by the front and rear side plates 31*a* and 31*b* in a rotatable manner. A rear end portion of the winding shaft 44 penetrates rearward through the rear side plate 31*b*. To the rear end portion of the winding shaft 44, a drive gear is fixed.

A motor is supported by the rear side plate 31*b*. To an output shaft of the motor, an output gear is fixed. The output gear is meshed with the drive gear of the winding shaft 44 via an idle gear, a warm gear and a warm wheel. Thereby, rotating force is transmitted from the motor to the winding shaft 44, and the front and rear winding pulleys 43F and 43R are rotated in one direction and in the other direction together with the winding shaft 44.

As shown in FIG. 4 and FIG. 5, a fixed connector 51 (for example, a drawer connector) is mounted to the rear side plate 31*b* at the lower end portion of almost the center portion in the left-and-right direction. When the conveyance unit assembly 17 is attached to the apparatus main body 3, the fixed connector 51 is connected to an output side connector provided in the apparatus main body 3. The output side connector is electrically connected to a power source and a control board provided in the apparatus main body 3.

Next, the moving unit 33 will be described with reference to FIG. 2 and FIG. 3. As shown in FIG. 2, the moving unit 33 is formed by a rectangular bottom plate 33*a* having a size capable of being stored in the storage part of the casing 31, front and rear standing plates 33*b* and 33*c* bent upwardly from front and rear edges of the bottom plate 33*a*, and left and right standing plates bent upwardly from left and right edges of the bottom plate 33*a*. In a center portion of the bottom plate 33*a*, a rectangular opening 33*d* (refer to FIG. 4 and FIG. 5) is formed. The moving unit 33 is supported in the storage part of the casing 31 in an upwardly and downwardly moving manner.

As shown in FIG. 3, on a front face of the front standing plate 33*b*, left and right front side movable pulleys 47FL and 47FR are supported in a rotatable manner at the left and right lower corners. On a rear face of the rear standing plate 33*c*, left and right rear side movable pulleys 47RL and 47RR are supported in a rotatable manner at the left and right lower corners.

As shown in FIG. 4 and FIG. 5, on the bottom plate 33*a*, a relay board 55 is fixed at the left side of the opening 33*d*. The relay board 55 is electrically connected to a motor and a speed sensor provided in the conveyance unit 35 described later. On a lower face of the bottom plate 33*a*, a movable connector 57 (for example, a drawer connector) electrically connected to the relay board 55 is mounted near the relay board 55. The movable connector 57 is arranged at the left front side of the fixed connector 51 in a plan view. Between the fixed connector 51 and the movable connector 57, a predetermined distance is formed in a plan view.

To the movable connector 57 and the fixed connector 51, both ends of a wire bundle W are connected. The wire bundle W is disposed a moving space between the bottom plate 31*c* of the casing 31 and the bottom plate 33*a* of the moving unit 33, through which the moving unit 33 is lifted and lowered. One end of the wire bundle W is connected to the fixed connector 51 along the front-and-rear direction and the other end of the wire bundle W is connected to the movable connector 57 along the left-and-right direction. That is, a connection direction of the wire bundle W to the fixed connector 51 is perpendicular to a connection direction of the wire bundle W to the movable connector 57. The wire bundle W has a length equal to or slightly longer than a distance between the fixed connector 51 and the movable connector 57 when the moving unit 33 is lifted.

When the conveyance unit assembly 17 is attached to the apparatus main body 3 and the fixed connector 51 is connected to the output side connector, the power source and the control board of the apparatus main body 3 are electrically connected to the motor and the speed sensor of the conveyance unit 35 via the wire bundle W and the relay board 55.

Both the ends of the wire bundle W are stored in a fixed wire guide 61 and a movable wire guide 63. Each wire guide is a member in which rectangular cylindrical link tubes are coupled to each other along a longitudinal direction of the wire bundle W rotatably in the upper-and-lower direction and in the left-and-right direction. The fixed wire guide 61 is fixed to the bottom plate 31*c* of the casing 31. In detail, the fixed wire guide 61 is fixed in a posture to be curved in an oblique left direction from the fixed connector 51 to an inside position apart from the fixed connector 51 via a predetermined distance. On the other hand, of the movable wire guide 63, one end (the link tube) nearest the movable connector 57 is supported on the bottom plate 33*a* of the moving unit 33 rotatably around a supporting shaft 63*a* along the upper-and-lower direction. That is, the movable wire guide 63 is rotatable around the supporting shaft 63*a* on a horizontal plane.

Next, the conveyance unit 35 will be described with reference to FIG. 1. The conveyance unit 35 includes a conveyance belt 73 configured to be circulated and a suction device 75. The conveyance belt 73 is wound around a pair of rollers and circulated in the counterclockwise direction in FIG. 1. An upper side track of the conveyance belt 73 is formed along the horizontal direction, and travels from the right side to the left side in FIG. 1. As shown in FIG. 1, the suction device 75 is disposed in a hollow space of the conveyance belt 73, and faces the upper side track of the conveyance belt 73. The suction device 75 generates a negative pressure in a space above the upper side track of the conveyance belt 73. The conveyance unit 35 is provided with a motor to rotate one of the pair of rollers and a speed sensor to detect the speed of the conveyance belt 73.

The conveyance unit 35 is placed on the bottom plate 33*a* of the moving unit 33. At this time, the motor and the speed sensor are electrically connected to the relay board 55. When the moving unit 33 is lifted by the lifting and lowering mechanism 37 (refer to a solid line in FIG. 1), the upper side track of the conveyance belt 73 of the conveyance unit 35 placed on the moving unit 33 is close to the discharge openings of the inkjet heads 23 of the head unit 15 to form an image forming path P (refer to FIG. 1) between the upper side track of the conveyance belt 73 and the discharge openings of the inkjet heads 23. On the other hand, when the moving unit 33 is lowered by the lifting and lowering mechanism 37 (refer to a chain line in FIG. 1), a predetermined space is formed between the conveyance unit 35 and the head unit 15.

As shown in FIG. 1, the treatment unit 19 includes caps 79 corresponding to the inkjet heads 23 of the head unit 15. The cap 79 has an oval cylindrical shape having a size larger than that of the inkjet head 23.

The treatment unit 19 is supported in a movable manner along the left-and-right direction between a treatment position below the head unit 15 and a retracting position at the left side of the treatment position. At the treatment position, the caps 79 face the corresponding inkjet heads 23 of the head unit 15.

With reference to FIG. 1, on a right side face of the apparatus main body 3, a discharge tray 81 and a manual bypass tray 83 are provided. The discharge tray 81 is disposed in an upper end portion of the right side face and the manual bypass tray 83 is disposed below the discharge tray 81.

Inside the apparatus main body 3, a conveyance path 85 for the sheet S is formed. The conveyance path 85 is formed from the sheet feeding devices 13 of the sheet feeding part 5 to the discharge tray 81 through the image forming path P. The conveyance path 85 has a switchback path 85*a* branched from a downstream side of the image forming path P and joined to an upstream side of the image forming path P in the conveyance direction. To the conveyance path 85, a manual bypass path 85*b* extending from the manual bypass tray 83 is joined at an upstream side of the joined portion of the switchback path 85*a* to the conveyance path 85.

Next, the image forming operation will be described. At the image forming operation shown in FIG. 1, the conveyance unit 35 is lifted, and the image forming path P is formed between the upper side track of the conveyance belt 73 and the discharge openings of the inkjet heads 23. The treatment unit 19 is moved to the retracting position.

First, the sheet is fed from the predetermined sheet feeding cassette 11 to the conveyance path 85 by the sheet feeding device 13. The fed sheet is conveyed to the image forming path P along the conveyance path 85. In the image forming path P, the suction device 75 of the conveyance unit 35 generates the negative pressure in the space above the upper sidetrack of the conveyance belt 73, and the sheet is conveyed while being sucked to the conveyance belt 73. Then, the ink is discharged from the discharge openings corresponding to an image data to form an image on the sheet. The sheet on which the image is formed is conveyed along the conveyance path 85 and then discharged on the discharge tray 81. When a duplex printing is performed, the sheet on one face of which the image is formed is conveyed to the switchback path 85*a* and is turned upside down. Then, after the image is formed on the other face of the sheet, the sheet is conveyed along the conveyance path 85 and then discharged on the discharge tray 81.

After the image forming operation is finished, the conveyance unit 35 is lowered and the treatment unit 19 is moved to the treatment position. Then, the treatment unit 19 is lifted and the inkjet heads 23 of the head unit 15 are covered with the corresponding caps 79 to prevent drying of the discharge openings of the nozzles.

Next, the lifting and lowering mechanism 37 will be described with reference to FIG. 3. The lifting and lowering mechanism 37 is constituted by a front side lifting and lowering mechanism 37F and a rear side lifting and lowering mechanism 37R.

The front side lifting and lowering mechanism 37F is constituted by a front side wire 49F, the left front side fixed pulley 41FL, the left and right front side movable pulleys 47FL and 47FR, the right front side fixed pully 41FR and the front side winding pully 43F. One end of the front side wire 49F is fixed to the left lower corner of the rear face of the front side plate 31*a* of the casing 31. The other end of the front side wire 49F is fixed to the front side winding pulley 43F. The front side wire 49F is wound around the left front side fixed pulley 41FL, the left and right front side movable pulleys 47FL and 47FR and the right front side fixed pulley 41FR in the order from the one end to the other end.

The rear side lifting and lowering mechanism 37R is constituted by a rear side wire 49R, the left rear side fixed pulley 41RL, the left and right rear side movable pulleys 47RL and 47RR, the right rear side fixed pully 41RR and the front side winding pully 43R. One end of the rear side wire 49R is fixed to the left lower corner of the front face of the rear side plate 31*b* of the casing 31. The other end of the rear side wire 49R is fixed to the rear side winding pulley 43R. The rear side wire 49R is wound around the left rear side fixed pulley 41RL, the left and right rear side movable pulleys 47RL and 47RR and the right rear side fixed pulley 41RR in the order from the one end to the other end.

When the winding shaft 44 is rotated in one direction and the other direction, the front and rear side wires 49F and 49R are wound or unwound around the front and rear side winding pulleys 43F and 43R via the fixed pulleys and the movable pulleys, and the moving unit 33 is lifted and lowered with respect to the casing 31.

When the moving unit 33 is lifted, the motor is driven to rotate the output shaft in the one direction. The rotation of the output shaft is transmitted to the drive gear of the winding shaft 44 via the idle gear, the warm gear and the warm wheel to rotate the drive gear. Thereby, the winding shaft 44 is rotated in the one direction, and the front and rear side wires 49F and 49R are wound around the front and rear side winding pulleys 43F and 43R via the movable pulleys of the moving unit 33 and the fixed pulleys of the casing 31. Then, the moving unit 33 on which the conveyance unit 35 is placed is lifted. When the moving unit 33 is lowered, the motor is driven to rotate the output shaft in the other direction.

A behavior of the wire bundle W accompanied with the lifting and lowering of the above moving unit 33 will be described with reference to FIG. 4, FIG. 5, FIG. 6A and FIG. 6B. As described above, the fixed wire guide 61 is fixed to the bottom plate 31*c* of the casing 31, and the movable wire guide 63 is supported on the bottom plate 33*a* of the moving unit 33 rotatably around the supporting shaft 63*a* on the horizontal plane.

Figure 6A:
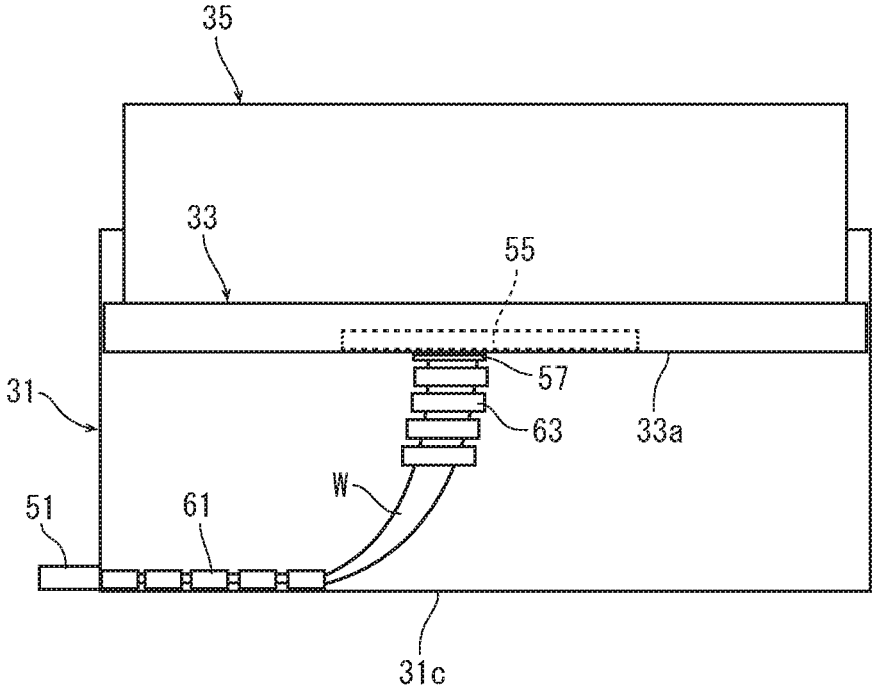
FIG. 6A is a front view schematically showing the conveyance unit assembly (when the moving unit is lifted) in the image forming apparatus according to the embodiment of the present disclosure.

In a state where the moving unit 33 is lifted, the distance between the fixed connector 51 and the movable connector 57 is almost equal to the length of the wire bundle W, and as shown in FIG. 4 and FIG. 6A, the wire bundle W is almost straightly wired between the fixed wire guide 61 and the movable wire guide 63 along an oblique direction. As shown in FIG. 4, the movable wire guide 63 is turned in the right rear direction toward the fixed wire guide 61.

Figure 6B:
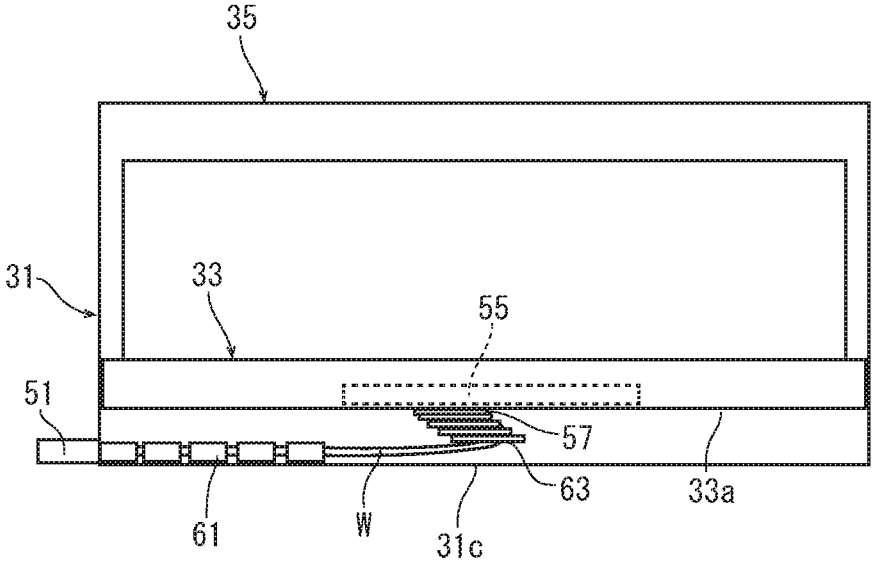
FIG. 6B is a front view showing the conveyance unit assembly (when the moving unit is lowered) in the image forming apparatus according to the embodiment of the present disclosure.

In a state where the moving unit 33 is lowered, the distance between the fixed connector 51 and the movable connector 57 becomes shorter than the length of the wire bundle W, and the wire bundle W is slacked by the difference between the distance and the length. Then, as shown in FIG. 5 and FIG. 6B, depending on the rigidity of the wire bundle W, the movable wire guide 63 is turned in the right front direction around the supporting shaft 63*a*. The slack of the wire bundle W is dragged along the bottom plate 31*c* of the casing 31 within the moving space such that it extends from the movable connector 57 toward the right front direction and then curves in the left rear direction toward the fixed wire guide 61.

As described above, according to the image forming apparatus 1 of the present disclosure, when the moving unit 33 is lowered and the distance between the fixed connector 51 and the movable connector 57 becomes shorter, the movable wire guide 63 is turned along the horizontal plane such that the slack of the wire bundle W is guided so as to be dragged on the bottom plate 31*c* of the casing 31 within the moving space. Accordingly, a difference between the distance between the fixed connector 51 and the movable connector 57 at the lowering of the moving unit 33 and the length of the wire bundle W is absorbed so that it becomes possible to guide the wire bundle W suitably without being applied with stress.

Additionally, because the fixed connector 51 is provided on the rear side plate 31*b* of the casing 31, when the casing 31 is attached to the apparatus main body 3, the fixed connector 51 is automatically connected to the output side connector of the apparatus main body 3. In addition, because the fixed connector 51 is provided at the lower portion of the rear side plate 31*b*, it becomes possible to decrease the height of the moving space and to decrease a height of the casing 31.

Additionally, the fixed connector 51 and the movable connector 57 are arranged via a predetermined distance in a plan view and the connection directions of the wire bundle W are perpendicular to each other. Accordingly, it becomes possible to make the length of the wire bundle W as short as possible. Then, it becomes possible to decrease the length of the slack of the wire bundle W at the lowering of the moving unit 33 and to release the slack on the horizontal plane easily.

Additionally, the fixed wire guide 61 is fixed to the bottom plate 31*c* of the casing 31 and the movable wire guide 63 is supported on the bottom plate 33*a* of the moving unit 33 rotatably on the horizontal plane. As described above, the fixed connector 51 is provided in the rear side plate 31*b* of the casing 31, and when the casing 31 is attached to the apparatus main body 3, the fixed connector 51 is automatically connected to the output side connector of the apparatus main body 3. When the casing 31 is attached to the apparatus main body 3, because the rear side plate 31*b* is applied with impact at the attaching, it is preferable to fix the fixed wire guide 61 to the bottom plate 31*c*. Then, the fixed wire guide 61 makes it possible to position the wire bundle W to the fixed connector 51 surely so that when the rear side plate 31*b* is applied with impact, it becomes possible to keep the connection of the fixed connector 51 and the wire bundle W.

However, the fixed wire guide 61 may be supported rotatably on the horizontal plane. In this case, the end (the link tube) nearest the fixed connector 51 of the fixed wire guide 61 is supported on the bottom plate 31*c* of the casing rotatably around a shaft along the upper-and-lower direction. Then, the fixed wire guide 61 is rotatable around the shaft on the horizontal plane. Alternatively, both the wire guides 61 and 63 may be supported rotatably on the horizontal plane.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. An image forming apparatus comprising:

a moving unit supported by a casing in an upwardly and downwardly moving manner;

a movable connector provided in the moving unit;

a fixed connector provided in the casing;

a wire both ends of which are connected to the movable connector and the fixed connector, the wire having a length longer than a distance between the movable connector and the fixed connector at lifting of the moving unit and disposed in a moving space between a bottom plate of the moving unit and a bottom plate of the casing;

a movable wire guide supported on the bottom plate of the moving unit and configured to store and guide one end portion of the wire; and a fixed wire guide supported on the bottom plate of the casing and configured to store and guide the other end portion of the wire, wherein at least one of the movable wire guide and the fixed wire guide is supported rotatably on a horizontal plane, and a slack of the wire at lowering of the moving unit is guided so as to be dragged along the horizontal plane in the moving space.

2. The image forming apparatus according to claim 1, wherein the movable wire guide is supported on the bottom plate of the moving unit rotatably on the horizontal plane.

3. The image forming apparatus according to claim 1, comprising an apparatus main body to which the casing is detachably attached, wherein the fixed connector is provided in a side plate at an upstream side in an attachment direction of the casing.

4. The image forming apparatus according to claim 1, wherein the fixed connector and the movable connector are disposed via a predetermined distance in a plan view, and a connection direction of the wire to the fixed connector is different from a connection direction of the wire to the movable connector.

5. The image forming apparatus according to claim 4, wherein the connection direction of the wire to the fixed connector is perpendicular to the connection direction of the wire to the movable connector.

6. The image forming apparatus according to claim 1, wherein the fixed connector is provided at a lower end portion of the casing.

* * * * *